US007445472B1

(12) United States Patent
Huang et al.

(10) Patent No.: US 7,445,472 B1
(45) Date of Patent: Nov. 4, 2008

(54) SAFETY ELECTRIC SOCKET

(76) Inventors: Fu-Hsiang Huang, No. 116, Chingtzu Lane, Chungshan Rd., Sec. 3, Wujih Hsiang, Taichung County (TW); Te-Lin Chan, No. 116, Chingtzu Lane, Chungshan Rd., Sec. 3, Wujih Hsiang, Taichung County (TW); Chih-Ping Yang, No. 116, Chingtzu Lane, Chungshan Rd., Sec. 3, Wujih Hsiang, Taichung County (TW)

( * ) Notice: Subject to any disclaimer, the term of this patent is extended or adjusted under 35 U.S.C. 154(b) by 0 days.

(21) Appl. No.: 11/907,302

(22) Filed: Oct. 11, 2007

(51) Int. Cl.
*H01R 13/44* (2006.01)

(52) U.S. Cl. ..... 439/138; 439/188

(58) Field of Classification Search ..... 439/137, 439/107, 188, 138, 135; 200/51.09
See application file for complete search history.

(56) References Cited

U.S. PATENT DOCUMENTS 4,271,337 A * 6/1981 Barkas ..... 200/51.09
5,320,545 A * 6/1994 Brothers ..... 439/188

* cited by examiner

*Primary Examiner*—Phuong K Dinh
(74) *Attorney, Agent, or Firm*—Rosenbeerg, Klein & Lee

(57) ABSTRACT

A safety electric socket in which two spring-supported doorplates are respectively pivoted to a holder block to block the neutral and hot slots against outside dust and water and to stop the spring-supported on/off switching button from downward movement. The doorplates are opened for allowing downward movement of the switching button to switch on power supply when the neutral and hot blades of an electric plug are respectively inserted into the neutral and hot slots.

1 Claim, 6 Drawing Sheets

SAFETY ELECTRIC SOCKET

BACKGROUND OF THE INVENTION

1. Field of the Invention

The present invention relates to an electric socket and more particularly, to a safety electric socket.

2. Description of the Related Art

To protect against outside dust or insertion of an external object, a safety electric socket may be covered with a detachable cover or provided with a sliding door. However, the user must remove the detachable cover or open the sliding door so that an electric plug can be connected to the electric socket. After removal of the electric plug, the user must close the sliding door or attach the detachable cover to the electric socket. This design of safety electric socket is inconvenient in use. Further, in order for enabling the user to cut off power supply when not in use, a safety electric socket usually will be provided with a power switch. When using the safety electric socket, the user must switch on the power switch. When the safety electric socket is not in use, the user must switch off the power switch. If the power switch of a safety electric socket is not switched off and its insertion slots are not covered with a sliding door or detachable cover, an accident of electric shock may occur when a child inserts a metal object into the insertion slots of the safety electric socket.

SUMMARY OF THE INVENTION

The present invention has been accomplished under the circumstances in view. It is the main object of the present invention to provide a safety electric socket, which automatically switches on power supply and opens the neutral and hot slots upon insertion of an electric plug, and automatically switches off power supply and blocks the neutral and hot slots after removal of the electric plug.

To achieve this and other objects of the present invention, the safety electric socket comprises a housing, a spring-supported on/off switching button extending out of the housing and movable to switch on/off power supply, a holder block mounted inside the housing, two spring-supported doorplates respectively pivoted to the holder block to block the neutral and hot slots of the housing against outside dust and water and to stop the spring-supported on/off switching button from downward movement. The doorplates are opened for allowing downward movement of the switching button to switch on power supply when the neutral and hot blades of an electric plug are respectively inserted into the neutral and hot slots of the housing.

DETAILED DESCRIPTION OF THE PREFERRED EMBODIMENT

Figure 1:
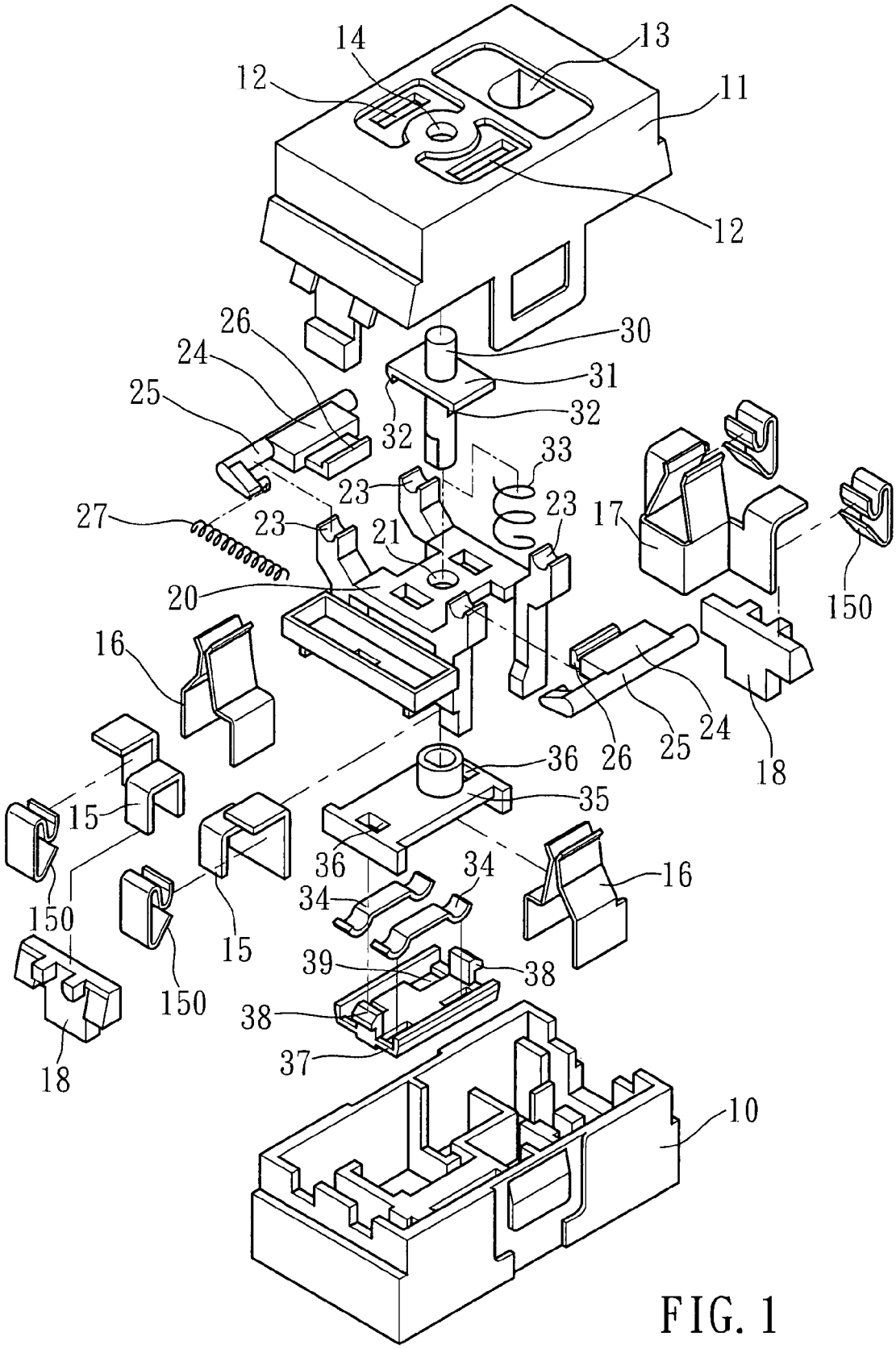
FIG. 1 is an exploded view of a safety electric socket in accordance with the present invention.
Figure 2:
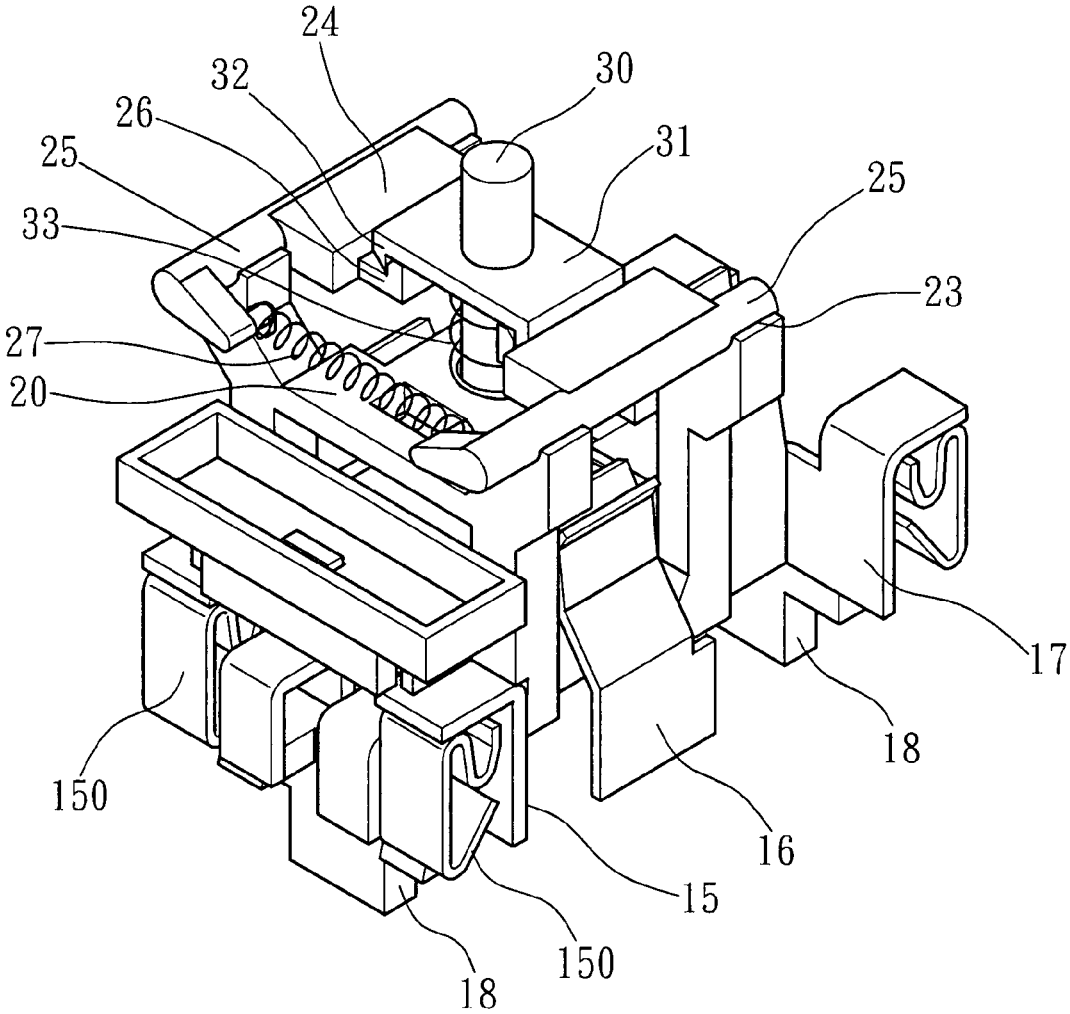
FIG. 2 is an elevational assembly view of the safety electric socket according to the present invention (the housing excluded).

Referring to FIGS. 1~5, a safety electric socket in accordance with the present invention is shown comprising a housing formed of a bottom cover shell 10 and a top cover shell 11. The top cover shell 11 has neutral and hot slots 12, a ground slot 13, and a through hole 14. The housing of the bottom cover shell 10 and top cover shell 11 houses two copper power terminals 15 of a power line 19, neutral and hot copper plates 16 and a ground copper plate 17 corresponding to the neutral and hot slots 12 and ground slot 13 of the top cover shell 11 for receiving the metal prongs 41 of an electric plug 40, a holder block 20, two doorplates 24, a button 30, a locating plate 35, and a retaining plate 37. The holder block 20 has a through hole 21 for the insertion of the button 30, and knuckles 23 disposed at two sides. The doorplates 24 each have a pivot shaft 25 respectively pivotally coupled to the knuckles 23 of the holder block 20, and a hook 26. A spring member 27 connected between the doorplates 24, supporting the doorplates 24 in a close position to block the neutral and hot slots 12 of the top cover shell 11. The button 30 has a top end inserted through the through hole 14 to the outside of the top cover shell 11, a bottom end inserted through the through hole 21 of the holder block 20 and coupled to the locating plate 35, a stop plate 31 stopped beneath the top cover shell 11, and two hooked portions 32 respectively protruded from two sides of the stop plate 31 and respectively hooked on the hooks 26 of the doorplates 24. A compression spring 33 is sleeved onto the button 30 and stopped between the stop plate 31 and the holder block 20. The locating plate 35 has two hook holes 36. The retaining plate 37 has two hooks 38 respectively hooked in the hook holes 36 of the locating plate 35, and two openings 39. Two metal conducting plates 34 are arranged between the locating plate 35 and the retaining plate 37, each having a part respectively exposed to the openings 39 of the retaining plate 37. The button 30 can be pressed downwards. When the downward pressure is released from the button 30, the compression spring 33 immediately pushes the button 30 upwards to force the stop plate 31 into contact with the bottom surface of the top cover shell 11. The locating plate 35, the retaining plate 37 and the metal conducting plates 34 are vertically movable with the button 30. When the button 30 is moved downwards, the metal conducting plates 34 are forced into contact with the copper power terminals 15 and the neutral and hot copper plates 16, and therefore the electric socket is switched on. When the button 30 is lifted, the electric socket is switched off. As stated above, the two hooked portions 32 of the stop plate 31 of the button 30 are respectively hooked on the hooks 26 of the doorplates 24. Therefore, when the doorplates 24 are not opened, the button 30 is prohibited from downward movement.

Figure 8:
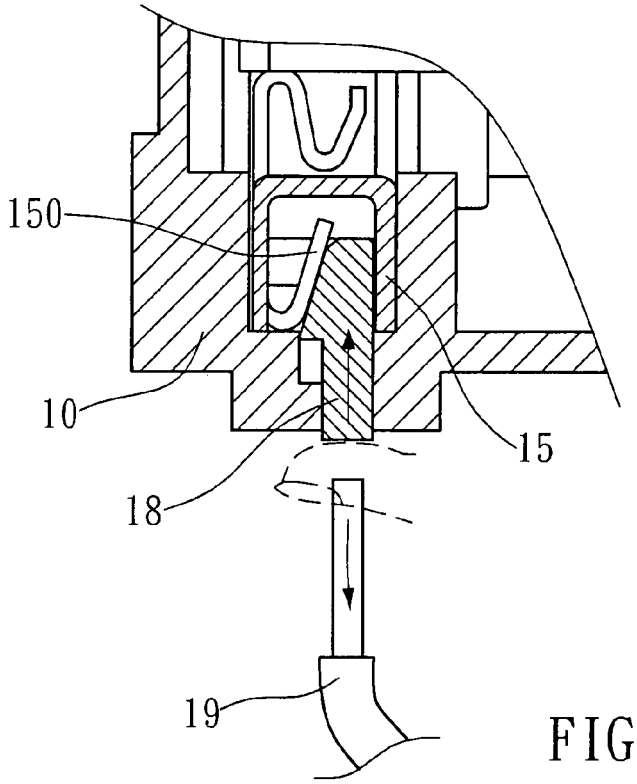
FIG. 8 is a schematic drawing of the present invention, showing the power line release control buttons pressed and the power line disconnected from the electric socket.
Figure 9:
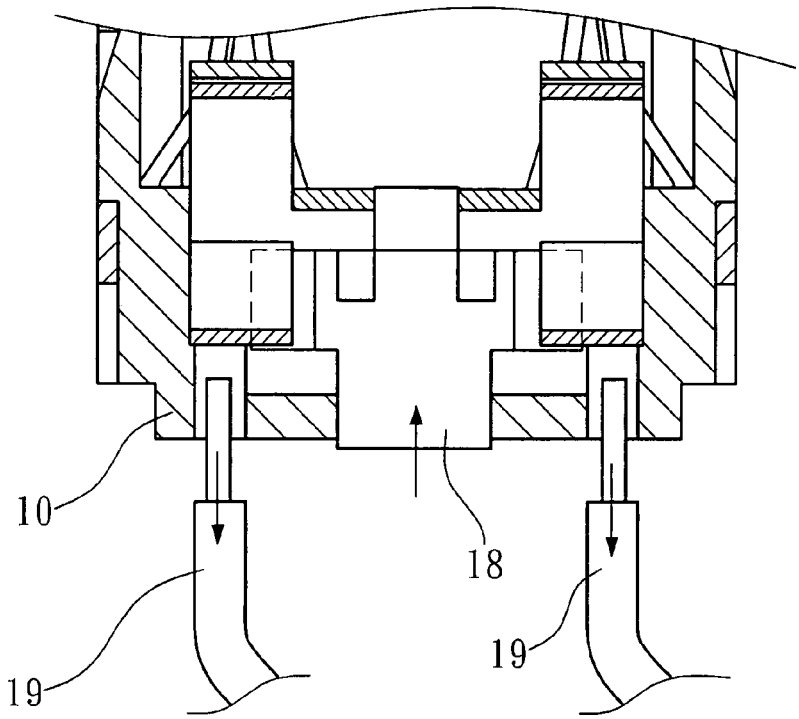
FIG. 9 corresponds to FIG. 8 when viewed from another angle.

Referring to FIGS. 8 and 9, two power line release control buttons 18 are bilaterally set between clamping plates 150 and the copper power terminals 15 of the power line 19 and ground copper plate 17 and partially extending out of the bottom cover shell 10. When the power line release control buttons 18 are pressed, the clamping plates 150 are forced away from the power line 19, and the power line 19 can then be removed from the electric socket.

Figure 3:
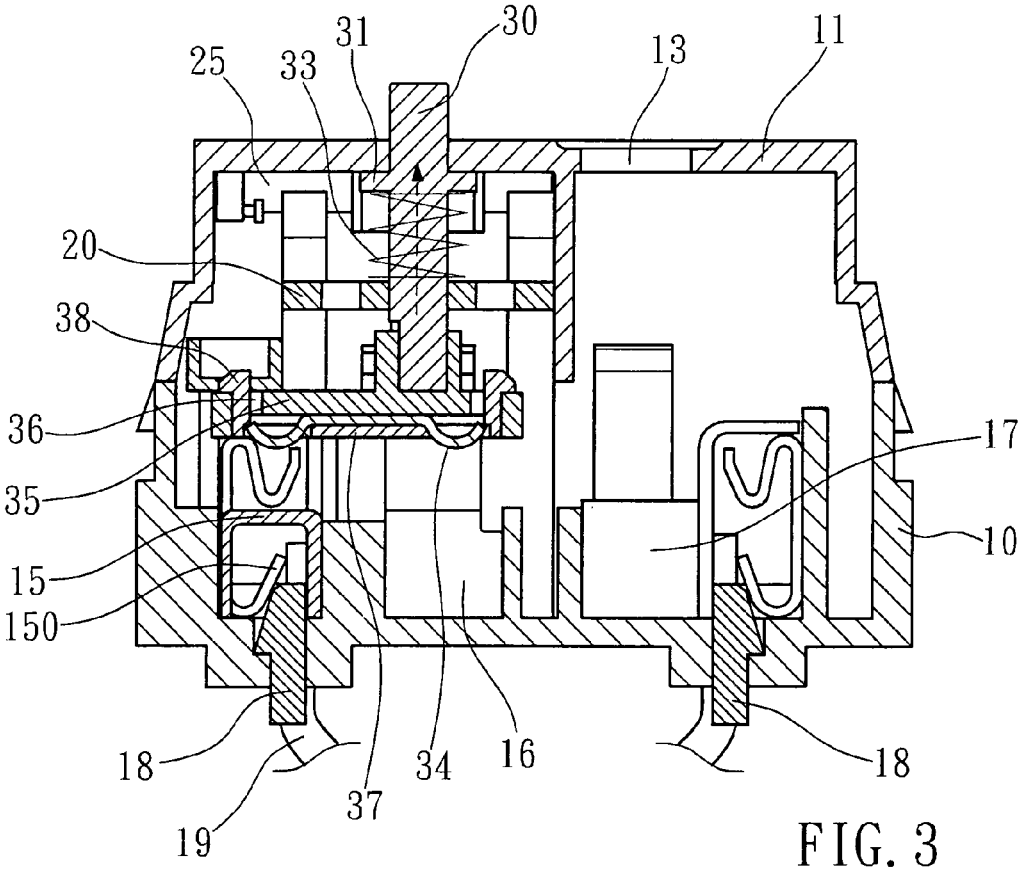
FIG. 3 is a sectional side view of the safety electric socket according to the present invention.
Figure 4:
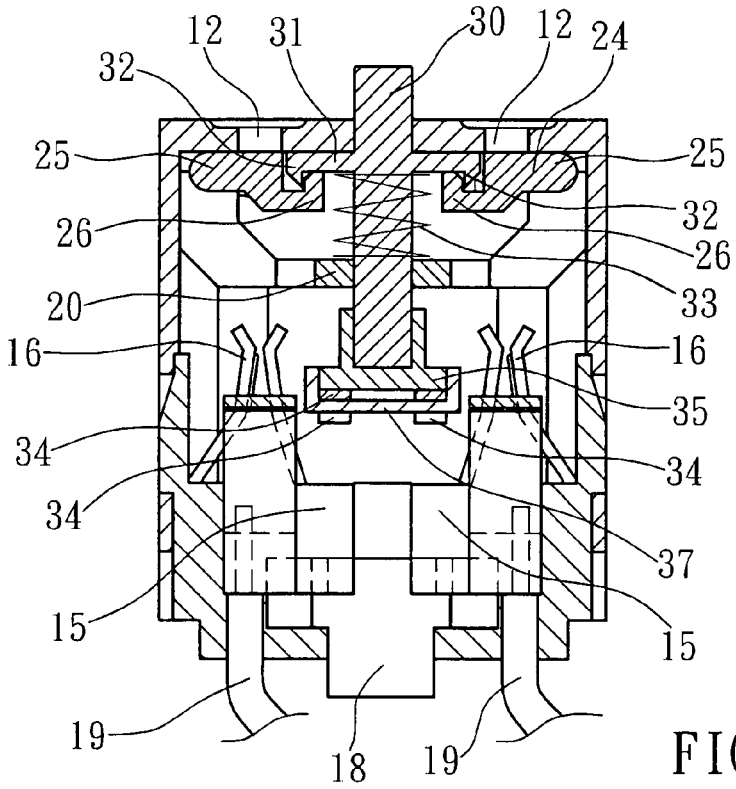
FIG. 4 is a sectional front view of the safety electric socket according to the present invention.

The invention has the following features and advantages:

1. Dust and water protection when the electric socket is not inserted with an electric plug. As shown in FIGS. 3 and 4, the compression spring 33 supports the button 30 in the off position, and the spring member 27 supports the doorplates 24 in the close position to block the neutral and hot slots 12 against outside dust and water.

2. The button 30 is prohibited from downward movement when the doorplates 24 are not opened. As shown in FIGS. 3 and 4, the two hooked portions 32 of the stop plate 31 of the button 30 are respectively hooked on the hooks 26 of the doorplates 24, and the compression spring 33 supports the button 30 in the off position. Therefore, when the doorplates 24 are not opened, the button 30 is prohibited from downward movement, i.e., the locating plate 35, the retaining plate 37 and the metal conducting plates 34 are prohibited from downward movement when the button 30 is prohibited from downward movement. At this time, the copper power terminals 15 are prohibited from contacting the neutral and hot copper plates 16, and therefore the electric socket is off.

Figure 5:
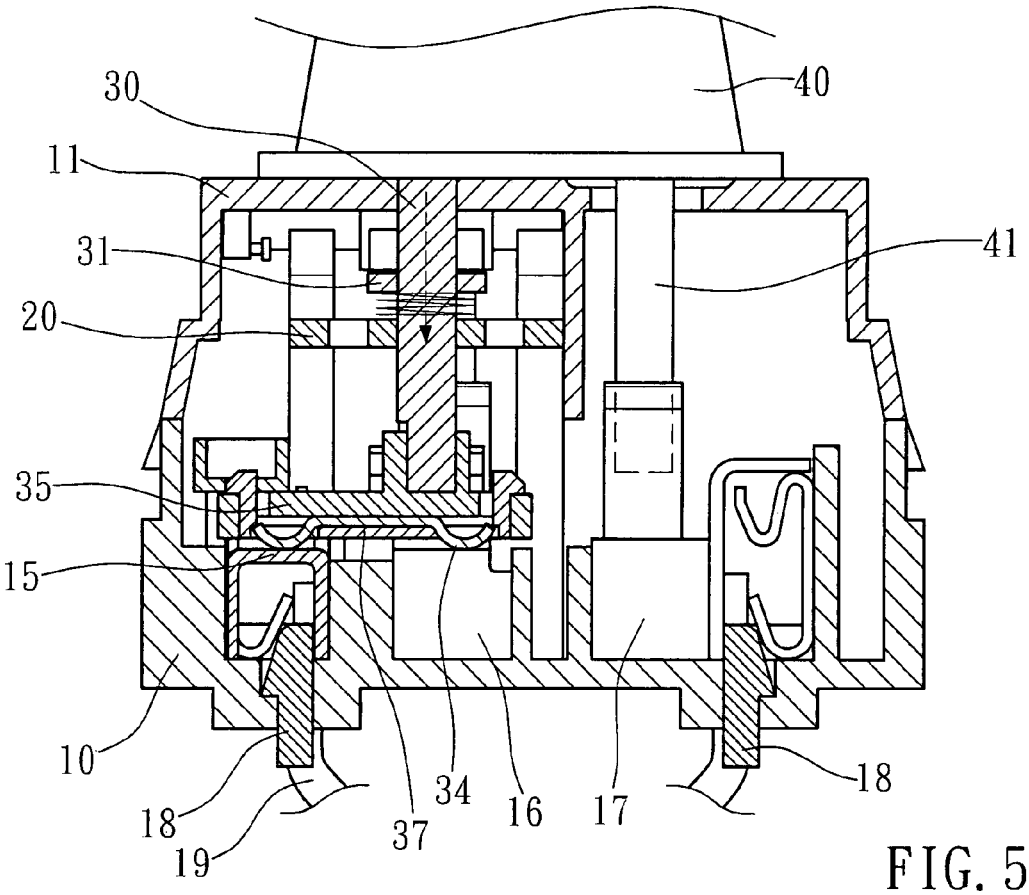
FIG. 5 is a schematic sectional side view of the present invention, showing an electric plug inserted into the electric socket.
Figure 6:
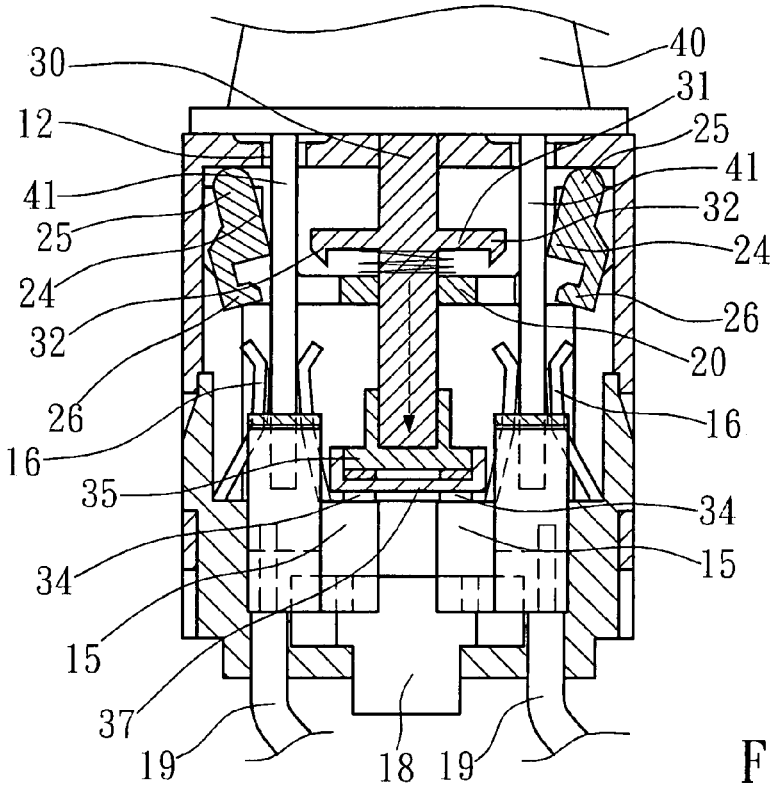
FIG. 6 is a schematic sectional front view of the present invention, showing an electric plug inserted into the electric socket.

3. The electric socket is on when an electric plug 40 is connected. As shown in FIGS. 5 and 6, when the two metal prongs (neutral and hot prongs) 41 of an electric plug 40 are respectively inserted into the neutral and hot slots 12, the doorplates 24 are turned from the close position to the open position to open the neutral and hot slots 12 and simultaneously to release the hook portions 32 of the stop plate 31 of the button 30. When continuously force the two metal prongs (neutral and hot prongs) 41 of the electric plug 40 into the inside of the neutral and hot slots 12, the button 30 will be forced downwards by the electric plug 40 to move the metal conducting plates 34 into contact with the copper power terminals 15 and the neutral and hot copper plates 16, and therefore the electric plug 40 are electrically connected to the power line 19. On the contrary, when removes the electric plug 40 from the electric socket, the compression spring 33 and the spring member 27 immediately return the button 30 and the doorplates 24 to their respective former positions to off the circuit, preventing an accidental short circuit.

Figure 7:
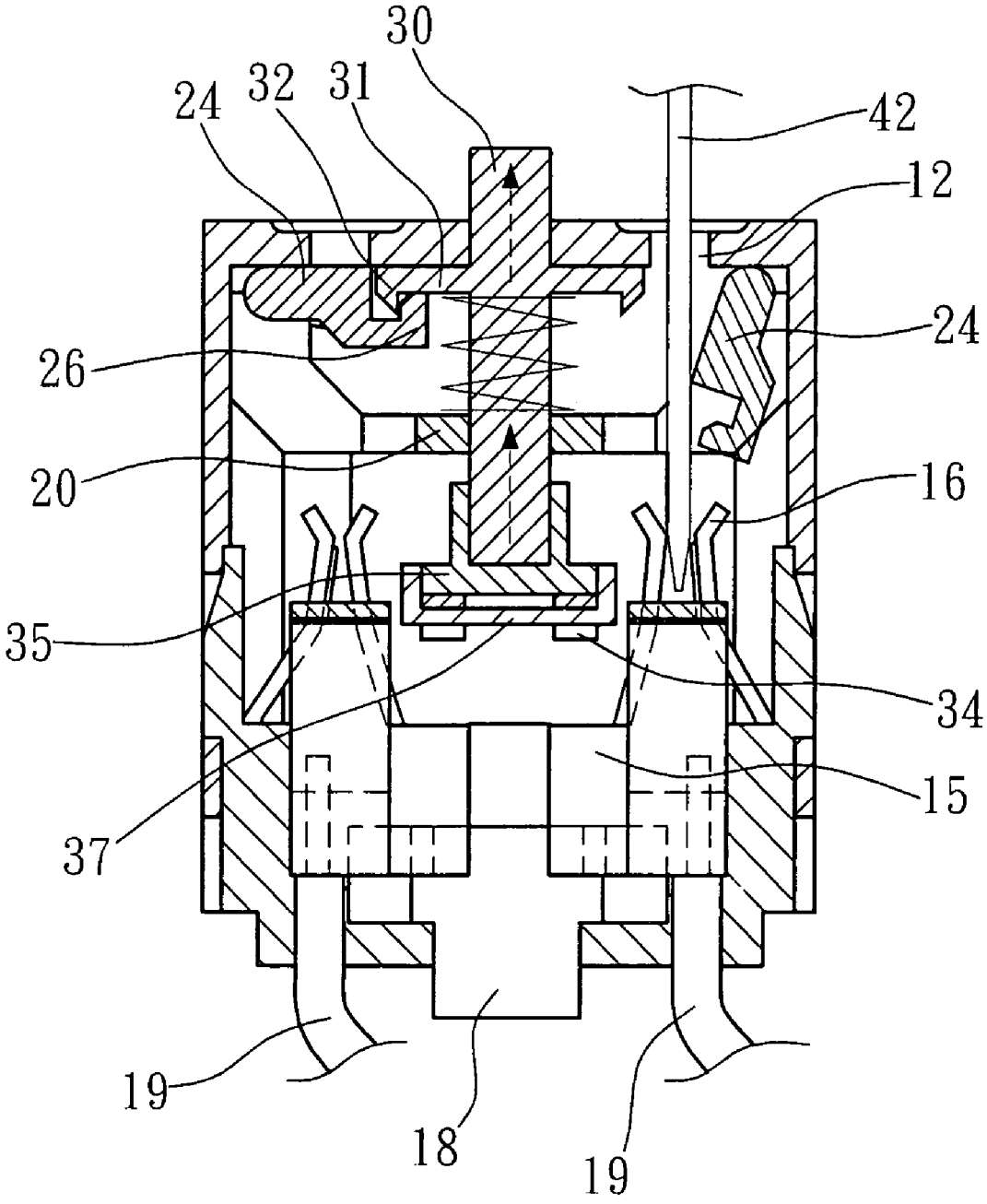
FIG. 7 is a schematic drawing of the present invention, showing an elongated external object inserted into one slot of the electric socket.

4. Electric shock prevention. As shown in FIG. 7, when a child inserts an object (for example, screwdriver) 42 into one hot slot 12 to open one doorplate 24 and to touch one (neutral or hot) copper plates 16, the button 30 is not lowered, and therefore the metal conducting plates 34 are still kept away from the copper power terminals 15 and the neutral and hot copper plates 16, i.e., the circuit of the electric socket is maintained off.

5. Quick disconnection of power line. As shown in FIGS. 8 and 9, when the power line release control buttons 18 are pressed, the clamping plates 150 are forced away from the power line 19, and the power line 19 can then be removed from the electric socket.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A safety electric socket comprising:

a housing, said housing comprising a bottom cover shell and a top cover shell covering said bottom cover shell, said top cover shell comprising neutral and hot slots, a ground slot, and a through hole;

two copper power terminals of a power line mounted inside said housing;

neutral and hot copper plates and a ground copper plate mounted inside said housing and respectively aimed at said neutral and hot slots and said ground slot of said top cover shell for receiving neutral and hot metal prongs and a grounding prong of an electric plug a holder block mounted inside said housing, said holder block having a through hole and knuckles disposed at two sides;

two doorplates for blocking the neutral and hot slots of said top cover shell, said doorplates each comprising a pivot shaft respectively pivotally coupled to the knuckles of said holder block, and a hook;

a spring member connected between said doorplates to support said doorplates in a close position where said doorplates block the neutral and hot slots of said top cover shell;

a locating plate mounted inside said housing, said locating plate having two hook holes;

a button, said button comprising a top end inserted through the through hole of said top cover shell to the outside of said top cover shell, a bottom end inserted through the through hole of said holder block and coupled to said locating plate, a stop plate stopped beneath said top cover shell, and two hooked portions respectively protruded from two sides of said stop plate and respectively hooked on the hooks of said doorplates;

a compression spring sleeved onto said button and stopped between said stop plate and said holder block;

a retaining plate mounted inside said housing, said retaining plate comprising two hooks respectively hooked in the hook holes of said locating plate, and two openings; and two metal conducting plates arranged between said locating plate and said retaining plate, said metal conducting plates each having a part respectively exposed out of the openings of said retaining plate;

wherein said locating plate, said retaining plate and said metal conducting plates are vertically movable with said button; when said button is pressed downwards, said metal conducting plates are forced into contact with said copper power terminals and said neutral and hot copper plates, and therefore the electric socket is switched on; when said button is released, said compression spring immediately returns said button and the electric socket is switched off.

* * * * *